US010472217B2

(12) United States Patent
Fahldieck et al.

(10) Patent No.: US 10,472,217 B2
(45) Date of Patent: Nov. 12, 2019

(54) FILLING APPARATUS

(71) Applicant: KHS GmbH, Dortmund (DE)

(72) Inventors: Andreas Fahldieck, Idar-Oberstein (DE); Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 440 days.

(21) Appl. No.: 15/309,373

(22) PCT Filed: Apr. 27, 2015

(86) PCT No.: PCT/EP2015/059077
§ 371 (c)(1),
(2) Date: Nov. 7, 2016

(87) PCT Pub. No.: WO2015/169630
PCT Pub. Date: Nov. 12, 2015

(65) Prior Publication Data

US 2017/0073208 A1 Mar. 16, 2017

(30) Foreign Application Priority Data

May 7, 2014 (DE) ..... 10 2014 106 404

(51) Int. Cl.
*B67C 3/20* (2006.01)
*B67C 3/28* (2006.01)
*B67C 3/22* (2006.01)

(52) U.S. Cl.
CPC ..... *B67C 3/206* (2013.01); *B67C 3/20* (2013.01); *B67C 3/28* (2013.01); *B67C 2003/228* (2013.01)

(58) Field of Classification Search
CPC .. B67C 3/206; B67C 3/20; B67C 3/28; B67C 2003/228
USPC ..... 141/147, 140, 150, 143; 53/272
See application file for complete search history.

(56) References Cited

U.S. PATENT DOCUMENTS 1,036,778 A * 8/1912 Baker ..... B67C 3/246 141/140
1,683,120 A * 9/1928 Ayars ..... G01F 11/32 141/140
1,953,642 A * 4/1934 Calleson ..... B67C 3/06 141/143

(Continued)

FOREIGN PATENT DOCUMENTS

DE 1 121 081 1/1962
DE 15 32 536 1/1970

(Continued)

*Primary Examiner* — Timothy L Maust
*Assistant Examiner* — James R Hakomaki
(74) *Attorney, Agent, or Firm* — Occhiuti & Rohlicek LLP

(57) ABSTRACT

An apparatus for filling containers with a product, includes a product supply, a pre-filling chamber having a controlled outlet, a movable sealing arrangement having a closed position for isolating the product supply from the pre-filling chamber, and a displacer arrangement that extends into the pre-filling chamber and that has an elastically deformable wall. The displacer arrangement is interactively connected to a control medium in such a way that an elastic volume change in the displacer arrangement changes a volume of the pre-filling chamber, thereby permitting control over an amount of product delivered through the outlet.

21 Claims, 14 Drawing Sheets

(56) References Cited

U.S. PATENT DOCUMENTS 2,043,578 A * 6/1936 De Markus ..... B67C 3/2637 141/294
2,126,402 A * 8/1938 Mapes ..... B67C 3/2637 141/294
2,222,617 A * 11/1940 Hothersall ..... B67C 3/04 141/140
2,529,937 A * 11/1950 Hale ..... G03C 1/74 222/263
2,560,005 A * 7/1951 Shawbrook ..... F16F 5/00 267/64.13
2,725,170 A * 11/1955 Day ..... B67C 3/2637 141/286
2,725,877 A * 12/1955 Reiter ..... A61M 5/20 604/135
2,758,747 A * 8/1956 Stevens ..... B67C 3/2637 141/147
2,761,605 A * 9/1956 Pahl ..... B67C 3/2637 141/147
2,761,607 A * 9/1956 Ayars ..... B67C 3/2637 141/147
2,776,785 A * 1/1957 Lyon ..... B67C 3/206 141/154
2,836,963 A * 6/1958 Fox ..... F17C 3/00 137/209
2,856,857 A * 10/1958 Saalfrank ..... F04B 43/067 417/385
3,076,479 A * 2/1963 Ottung ..... F01P 11/029 138/30
3,096,914 A * 7/1963 Kerr ..... B65B 39/001 222/333
3,162,335 A * 12/1964 Kogan ..... B67D 1/0462 222/386.5
3,294,289 A * 12/1966 Bayne ..... B67D 1/0462 222/386.5
3,315,700 A * 4/1967 Greenwood ..... F16K 51/02 137/375
3,316,945 A * 5/1967 Brinkley ..... B65B 3/305 141/140
3,415,277 A * 12/1968 Mitchell ..... F02K 9/605 137/593
3,426,812 A * 2/1969 Brinkley ..... B65B 3/323 141/140
3,481,109 A * 12/1969 Pavey ..... B65B 55/04 53/167
3,561,644 A * 2/1971 Works ..... B65D 83/62 222/95
3,662,929 A * 5/1972 Sims ..... F04B 43/10 222/386.5
3,830,264 A * 8/1974 Billett ..... B65B 3/323 141/1
3,949,791 A 4/1976 Vadas
4,271,989 A * 6/1981 O'Neill ..... F01L 25/08 137/625.25
4,453,577 A * 6/1984 Romberg ..... B67D 7/465 141/209
4,527,580 A * 7/1985 Chheda ..... F15B 1/103 137/1
4,569,378 A 2/1986 Bergandy
4,893,659 A * 1/1990 Loliger ..... B65B 55/022 141/105
5,085,354 A * 2/1992 Sogliani ..... B60T 8/4872 141/147
5,230,373 A * 7/1993 Engler ..... B65B 3/12 141/146
5,238,156 A * 8/1993 Andris ..... B05B 11/007 222/207
5,346,476 A * 9/1994 Elson ..... A61M 5/148 604/135
5,654,041 A * 8/1997 Appich ..... B05C 9/02 118/401
5,875,931 A * 3/1999 Py ..... B05B 11/3084 222/137
5,915,593 A * 6/1999 Bancon ..... B05C 11/10 222/146.5
5,960,838 A * 10/1999 Tietz ..... B67C 3/204 134/169 R
6,073,667 A * 6/2000 Graffin ..... B67C 3/202 141/372
6,923,223 B2 * 8/2005 Trzmiel ..... F15B 1/103 138/30
7,316,336 B2 * 1/2008 Kaartinen ..... G01F 11/086 222/209
9,376,307 B2 * 6/2016 Fahldieck ..... B67C 3/2608
2012/0012224 A1 * 1/2012 Haeuslmann ..... B67C 3/202 141/1
2012/0060973 A1 * 3/2012 Jaeger ..... B67C 3/202 141/83
2012/0241044 A1 * 9/2012 Krulitsch ..... B67C 3/023 141/9
2013/0112311 A1 * 5/2013 Krulitsch ..... B67C 3/26 141/1

FOREIGN PATENT DOCUMENTS

DE 22 31 082 1/1974
DE 27 34 251 2/1979
DE 41 20 924 1/1993
DE 19918430 A1 * 11/2000 ..... B65B 3/32
EP 0 775 635 5/1997
FR 2 851 764 9/2004
GB 1 231 974 5/1971
WO WO00/46103 8/2000

* cited by examiner

FILLING APPARATUS

RELATED APPLICATIONS

This application is the national stage under 35 USC 371 of international application PCT/EP2015/059077, filed on Apr. 27, 2015, which claims the benefit of the May 7, 2014 priority date of German application DE 102014106404.6, the contents of which are herein incorporated by reference.

FIELD OF INVENTION

The present invention relates to a filling apparatus, in particular an apparatus for filling containers with a filling material that includes liquid with suspended solids.

BACKGROUND

Certain filling products include both liquid and suspended fibers or solids, such as pieces of fruit or cereals. When filling with such filling products, it is common to add a specific amount of solid matter into the container in a first step, and to then add liquid to fill the container. These two steps usually take place in two filling machines that operate separately from one another.

A common way to pre-proportion the solid matter is to use mechanical piston fillers. Given their piston/cylinder design and their very high degree of mechanical complexity, these fillers are not so easy to clean and sterilize. A particular disadvantage of the piston/cylinder is that it has sliding surfaces that can only be cleaned with a great deal of effort. In many cases, cleaning these sliding surfaces will require removing the entire piston. This means that during the cleaning procedure, it is not possible to sterilize with steam. This is because, since the system is open, it is not possible to build the pressure needed to make the steam hot enough to sterilize.

SUMMARY

An object of the invention is to provide a filling apparatus that allows the simple and effective cleaning and/or sterilizing of the filling apparatus, without having to disassemble the apparatus.

In one aspect, the invention, the filling apparatus has a product supply such as a product container, a pre-filling chamber and a controllable outlet. The outlet is usually constituted by an electrically or pneumatically controlled valve that comprises two parts that can move relative to one another and that open or close an outlet opening.

The filling apparatus also comprises a movable, e.g. linearly movable, sealing arrangement, for example a piston arrangement. When in an open position, the sealing arrangement connects the product supply with the pre-filling chamber. When in a closed position, it isolates the product supply from the pre-filling chamber. If the sealing arrangement is preferably configured as a piston arrangement that can be actuated in the direction of the pre-filling chamber, then this has the advantage that the piston of the piston arrangement can be pressed up against a seal seat of the pre-filling chamber, thereby isolating the pre-filling chamber from the product supply. No relative sliding motion occurs between the seal faces in this case. There is only a pressing motion. This means that the corresponding seal faces can be easily cleaned and/or sterilized in place. The sealing arrangement can of course be moved on any desired path. For example, it can move along a linear path, a circular path, or a helical path.

The filling apparatus also comprises a flexible displacer arrangement whose volume in the pre-filling chamber is adjustable. A displacer arrangement of this type can be formed, for example, by a bellows or by an expandable elastic body such as a rubber bag. The change in volume of the bellows or elastic body can be brought about, for example, by a mechanical arrangement, such as a piston arrangement. Or it can be brought about hydraulically or pneumatically.

A significant aspect of the displacer arrangement is that, on the side facing the pre-filling chamber, it has a surface layer that is constant or unchanging because it comprises at least one elastically deformable wall or at least one deformable wall section. The size of the wall or surface layer changes at most through its elastic material deformation (e.g. with a rubber bag or rubber balloon) or flexibility of the wall (for example, with a bellows), i.e. through changes in the position of sections of the wall layer or surface layer relative to one another, such as with a bellows for example.

In this way the cleaning problem of known piston arrangements, in which a piston travels from a cylinder into the pre-filling chamber, is avoided. In these known piston arrangements, the sliding surfaces of the piston and of its accompanying cylinder cannot be fully cleaned in normal operation. They can only be by fully extending the piston. This is very laborious with piston fillers.

Thanks to this special arrangement, irrespective of the volume of the displacer arrangement protruding into the pre-filling chamber, the pre-filling chamber always "sees" the same surface, namely the surface of the flexible or elastic deformable wall or wall sections, so the product is not in contact with any surfaces or seal faces that slide or rub against one another.

A suitable controlling or driving means, such as an incompressible fluid, a mechanical arrangement, such as a piston arrangement, or a combination of hydraulic and mechanical drive, can engage in the interior of the displacer arrangement, i.e. on the side facing away from the pre-filling chamber.

As used herein, an elastic material is a material having reversible deformability of at least 10% to 20%. The term "flexible" can also be interpreted to mean that fixed components are arranged so as to be able to move relative to one another, such as for example with a plate bellows.

What these arrangements all have in common however is that a sealing element that is in contact with the product does not rub against a wall. This differs from conventional piston/cylinder arrangements, in which the piston seal rubs along the inner wall of the cylinder in order to change the volume.

A further advantage is that once the pre-filling chamber has been isolated from the product supply, it becomes possible to discharge a defined volume solely by increasing the volume of the displacer arrangement in the pre-filling chamber with the outlet open. This can be done without any surfaces of a proportioning arrangement, which may come into contact with the product, sliding against one another.

Yet another advantage of the filling apparatus is that one can avoid having the movement of a piston in a cylinder be the agent of product delivery. By doing so, one avoids contact between difficult-to-clean sliding-seal faces and product. Instead, the filling apparatus achieves product delivery by adjusting the volume of a flexible displacer arrangement that has been strategically located within the pre-filling chamber.

In carrying out this filling operation, the displacer arrangement expands from a first volume up to a second volume. This change in volume, referred to herein as the "displacement volume," exactly equals the volume of delivered product.

There are several ways to carry out this volume expansion. One way is to use a piston that has been sealed off from the pre-filling chamber by a bellows. In that case, the expansion of the bellows defines the displacement volume.

Another way to carry out this volume expansion is to use an elastic geometric-form. An example of such a form is an elastic balloon. The elastic geometric form can be made of a variety of materials, such as rubber. In this embodiment, one adjusts the elastic form's volume by applying fluid into the elastic form's interior. The resulting expansion of the elastic form defines the displacement volume.

Different displacer arrangements are consequently possible to displace a displacement volume from the pre-filling chamber, and more importantly, to do so without having to have two parts that move relative to one another along a seal face that comes into contact with the product.

An apparatus as described herein is thus easy to clean. Although there are still seal faces that come into contact with one another, these are only the seal faces of the sealing arrangement that seal off the product supply from the pre-filling chamber.

In some embodiments, the pre-filling chamber is adjacent to a product container. In these embodiments, the sealing arrangement can be configured simply as a piston or plunger that covers the connection between the product container and the pre-filling chamber. This can just be a lip seal that comes into contact with the product container. It is thus possible to seal the sealing arrangement without any sliding relative movement of two sealing components. This feature promotes easier cleaning.

Examples of filled product include a granulated solid, a liquid that contains solids, or a liquid of any viscosity. The only real requirement is that the filled product must be pourable or free flowing.

It is particularly easy to engineer a sealing arrangement that is configured as a linearly-movable piston arrangement that can be moved to isolate the pre-filling chamber from the product supply by being moved from an open position to a closed position.

In some embodiments, the piston arrangement is a dual-piston arrangement having an outer piston and an inner piston that are arranged concentrically and that interact telescopically. In such an embodiment, the outer piston forms a sealing arrangement and the inner piston forms a displacer arrangement. In this embodiment, one fills the container by moving the outer piston towards the pre-filling chamber into the closed position to isolate the product supply from the pre-filling chamber, opening the outlet of the pre-filling chamber, and moving the inner piston, which is sealed from the outer piston by a bellows, into the pre-filling chamber. This causes it to displace a defined volume, which is then discharged through the outlet to fill the container.

The sealing function of the pre-filling chamber as well as the displacer function is therefore simple to realize technically in a single function unit using a dual-piston arrangement of this type. In some embodiments, a single actuator actuates both the inner and outer piston. In other embodiments, the inner and outer pistons have their own respective actuators.

In some embodiments, an actuator that moves the inner piston also moves the outer piston. In such embodiments, the forces for the movement of the inner and outer piston relative to one another and to the product container are preferably matched. As a result, upon its deflection, the actuator moves the outer piston first, and only the outer piston. It is only when the outer piston has reached its sealing position that the inner piston begins to move. Because the dual-piston arrangement carries out both the sealing function, which isolates the product supply and the pre-filling chamber, and the displacement function in the pre-filling chamber, it becomes much simpler to engineer the product container and the pre-filling chamber.

In some embodiments, an actuator operates the outer piston so that it can be controlled to move from the closed position to the open position.

In other embodiments, a bellows isolates the outer piston from the product supply, e.g. the product container. As a result there are no seal faces that come into contact with the product between the product supply and the outer piston. In this embodiment, elastic deformation of the bellows during the operation of the inner and outer piston sealed against the product causes the relative movements of the dual-piston arrangement.

In some embodiments, the actuation element for operating the inner piston is a pushrod that interacts with a control surface via a roller or slide shoe. However, in other embodiments, a drive operates the pushrod. Examples of a pushrod's drive include a hydraulic cylinder and an electric stepper motor.

In some embodiments, the pushrod connects to a piston element and the outer piston has an axial bore within which the piston element moves. Among these are embodiments in which the inner piston, together with the bellows, is attached to one end of the outer piston and connected to the bore with fluid between the piston element and the inner piston, i.e. the bellows. An advantage of this is that through the linear adjustment of the pushrod and hence of the piston element, i.e. the stroke of the piston element, it becomes possible to exactly set the displaced volume of the displacer arrangement without having to accurately determine the volume of a geometrically complex body, such as a bellows. In addition, the pressures are transmitted from the actuation element to the inner piston virtually friction-free and with minimal wear.

Some embodiments have a controllable valve at the outlet for controlling the filling operation. Among these are embodiments that have a controller for controlling the controllable valve. A suitable controller is an electronic controller of the filling plant, for example a microprocessor controller.

In some embodiments, the valve has an elastic membrane that encloses an outlet opening that interacts with a closing element. In this case, relative movement of the elastic membrane relative to the central seal element opens the pre-filling chamber to cause a controllable output. This relative movement occurs without the need for sliding surfaces that could come into contact with the product. In this way, the elastic membrane in the outlet or valve creates a moving closing element, and in so doing, dispenses with the need for sliding seal faces.

In an alternative embodiment, the displacer arrangement controls the maximum pre-filling volume in the pre-filling chamber. In this embodiment, a partially-expanded displacer arrangement initially limits the volume in the pre-filling chamber. Or, the partially-expanded displacer arrangement displaces a partial volume back out of the pre-filling chamber and into the receiver tank during the pre-filling chamber's closing step. Then, one opens the release valve of the outlet opening. This will permit a further volume increase of the displacer arrangement to fully or partially empty a further volume from the pre-filling chamber for filling the container.

These process variants reduce the time required to re-fill the proportioning chamber and thereby increase speed of filling and overall throughput.

The filling apparatus described is easy to clean, especially using clean-in-place and sterilize-in-place cleaning procedures, particularly when filling with solids or with liquids that have suspended solids. The filling apparatus as disclosed herein further permits sealed clean-in-place and sterilize-in-place cleaning procedures. This is particularly useful because of the rising consumption of fruit drinks, wellness drinks, and sports drinks that contain small fruit pieces, fruit-fibers, or cereals. However, the filling apparatus is not restricted to such products and can also be used just for filling solids or liquids.

The apparatus disclosed herein makes it possible to dispense with sliding seals in the region occupied by the product in the filling apparatus. There are only two seated valves, one in the region of the sealing arrangement between product feed and pre-filling chamber, and one in the outlet with the controllable valve. Neither valve comprises surfaces that slide on one another.

Some embodiments also feature a load cell used in the pre-filling chamber. In these embodiments, the weight is not determined until filling is complete. In this way, the load cell can be used to accurately determine the filled mass or weight.

Among the embodiments are those in which the inner and the outer piston of the dual-piston arrangement are driven mechanically, for example, by an actuation element. A suitable actuation element is a pushrod.

Alternative forms of actuation are also possible. For example, some embodiments rely on a processor-controlled linear motor or a hydraulic or pneumatic controller. In the case of the linear motor, the volume can be accurately determined as a function of the stroke.

This coupling fluid can be present either in an inner volume that can be varied by way of a cylinder and be supplied to and discharged from the proportioning bellows (second bellows) by way of a displaceable cylinder, or in a fixed inner volume that is connected to at least one balancing tank, with the coupling fluid being supplied and discharged by way of pumps, and with the amount of the coupling fluid being detected and controlled by way of a suitable volume-measuring system.

If there is a closed inner volume that is supplied and discharged by way of a piston arrangement or a cylinder, then a feed line is provided that facilitates the initial filling and determining of the volume of coupling fluid. Balancing tanks that are in fluid communication with each other can be provided as necessary for one or a plurality of such filling elements or for the coupling fluids.

In the event that the coupling fluid is present in the interior of the proportioning bellows, a softer material can also be chosen for the bellows.

The bellows, which seals the inner piston from the outer piston, consists preferably of Teflon, soft metal, a stiff plastic, or a material that prevents radial constriction due to the applied pressures.

The apparatus described herein achieves a mechanically simple construction that can be cleaned thoroughly by minimizing the number of contact surfaces. Thorough cleaning is possible during a clean-in-place procedure because all contact surfaces can be separated from one another and there are no sliding surfaces of any kind. In this way the filling apparatus permits cold aseptic filling.

The product supply need not be a product container. In some embodiments, it is a supply channel.

These and other features of the invention will be apparent from the following detailed description and the accompanying drawings, in which:

BRIEF DESCRIPTION OF THE DRAWINGS

In the drawings, parts that are identical or have the same functions are indicated by identical reference numbers.

DETAILED DESCRIPTION

Figure 1:
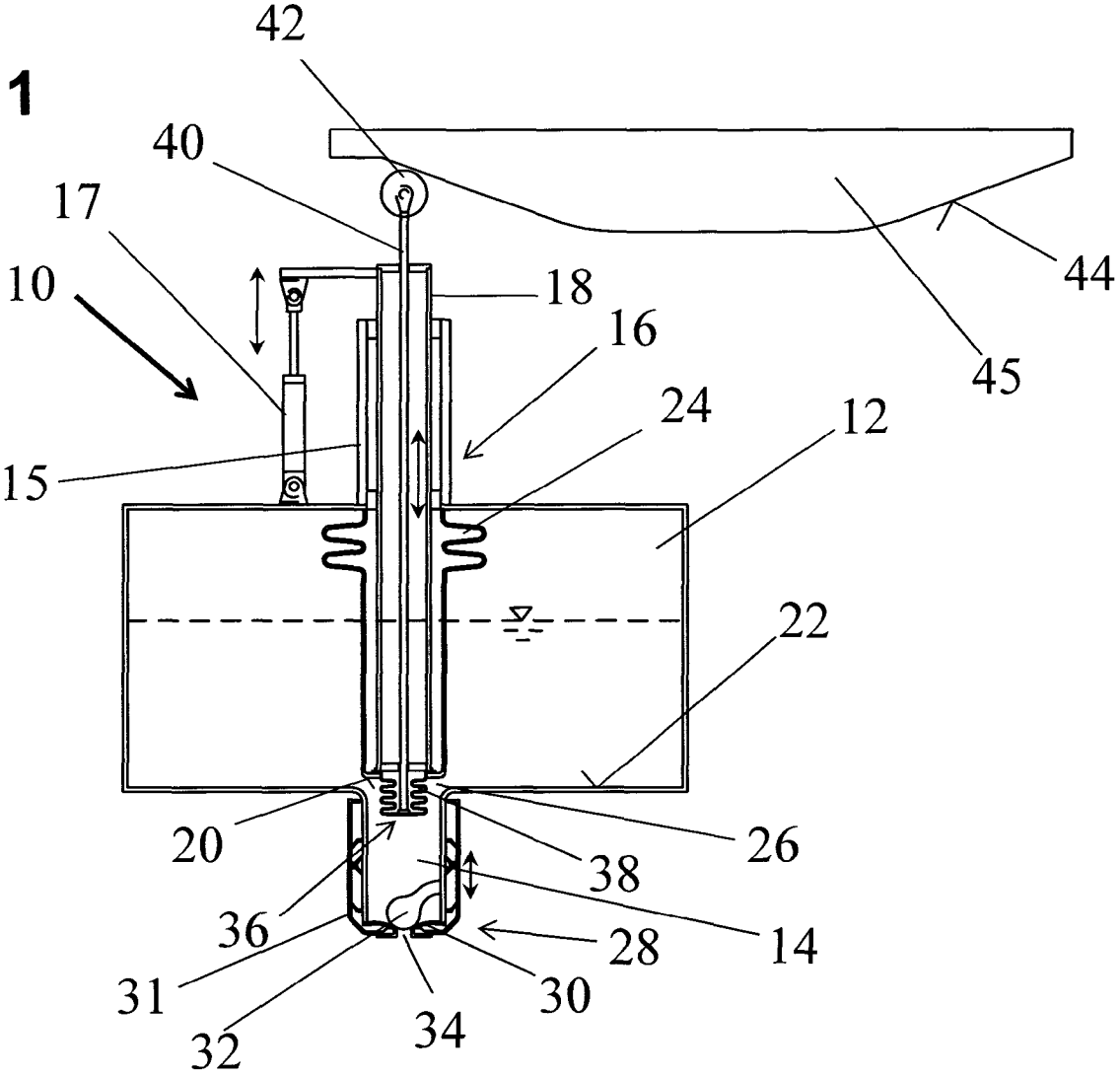
FIGS. 1 to 8 show partial-section side views of a first embodiment of a filling apparatus having a dual-piston arrangement in different phases of a filling operation.

As shown in FIG. 1, a filling apparatus 10 includes a product container 12 having a base 22. This product container 12 acts as a product supply. Attached beneath the product container 12 is a pre-filling chamber 14.

The filling apparatus 10 includes a dual-piston arrangement 16 having an outer piston 18 and an inner piston 36 that are arranged concentrically relative to one another. The inner piston 36 and the outer piston 18 can be moved axially relative to the product supply 12 and to one another. For this purpose, a guide 15 holds the dual-piston arrangement 16 on the product container 12 or on a construction element connected to the product container 12.

An actuator 17 adjusts the outer piston 18 axially relative to the product container 12. Examples of a suitable actuator 17 include a hydraulic cylinder, a pneumatic cylinder, and an electric motor.

A first bellows 24 encloses the outer piston 18, thus sealing it off from the product container 12. In some embodiments, the first bellows 24 is made from an elastic material.

A lower end 20 of the outer piston 18 permits the outer piston to seal off the pre-filling chamber 14 from the product container 12. This lower end 20 faces the pre-filling chamber 14 that is being pressed against the product container's base 22. The resulting sealing arrangement has no sliding seal-faces. As a result, the outer piston 18 isolates the pre-filling chamber 14 from the product container 12 in a way that avoids having any sliding seal-faces provided anywhere in the entire product region.

Meanwhile, a second bellows 38 seals off the inner piston 36 from the outer piston 18. This second bellows 38 is smaller than the first bellows 24 and also more resistant to deformation than the first bellows 24. It acts as a displacer arrangement as soon as the outer piston 18 has sealed off the pre-filling chamber 14 from the product container 12.

A valve 28 forms an outlet on an underside of the pre-filling chamber 14. A suitable valve 28 is an electrically or pneumatically controllable valve having a permanently arranged seal 32 that is arranged over an outlet 34 in the center of an elastic membrane 30. In some embodiments, the seal 32 is spherical. An adjustable control cylinder 31 holds or encloses the membrane 30. This control cylinder 31 causes the membrane 30 to be pressed against or to be moved away from the seal 32, thereby closing or opening the outlet 34.

A pushrod 40 connected to an end of the inner piston 36 moves the inner piston 36 relative to the product container 12. As it moves, the inner piston 36 entrains the outer piston 18, provided the movement is enabled by the actuator 17, or both pistons move together.

At its upper end, the pushrod 40 carries a roller 42 that travels along a guide surface 44 of a control element 45. As a result, the pushrod 40 deflects by an amount that corresponds to the vertical profile of the guide surface 44.

The second bellows 38 transmits the inner piston's movement to the outer piston 18 via the second smaller bellows 38. Because the second bellows 38 is more resistant to deformation than the first bellows 24, when the pushrod 40 moves, the outer piston 18 is first moved by way of the inner piston 36 and its bellows 38 until the bottom end 20 of the outer piston 18 lies against the base 22 of the product container 12. In this state, the pre-filling chamber 14 is sealed off from the product container 12.

In an alternative implementation, the actuator 17 moves the outer piston 18 and the pushrod 40 moves either the inner piston 36 or the bellows 38. This embodiment includes a fixed-position guide sleeve with sealing elements between it and the outer moving piston 18. In some of these implementations, a space between the fixed-position guide sleeve and the piston 18 can also be purged with a liquid or gas. In others of these implementations, appropriate connections connect this space to a cleaning circuit.

Upon a further movement of the pushrod 40, the inner piston 36 moves forward out of the lower end 20 of the outer piston 18. This brings about a corresponding displacement of product in the pre-filling chamber 14. The resulting displacement causes a product discharge of a corresponding volume through the valve 28 and into a container that is to be filled. The container can be a can, a bottle, or a keg.

FIGS. 1-8 show positions of the individual components of the filling apparatus 10 as the filling operation progresses.

The sequence begins, as shown in FIG. 1, with the outer piston 18 in the open position at the start of the filling operation. With the outer piston 18 in this position, a feed 26 forms between the lower end 20 of the outer piston 18 and the product container's base 22. Product passes through this feed 26.

The control cylinder 31 presses the movable membrane 30 against the seal 32. As a result, the seal 32 closes the outlet 34 at the membrane's center. Product continues to flow until it completely fills the pre-filling chamber 14.

Figure 2:
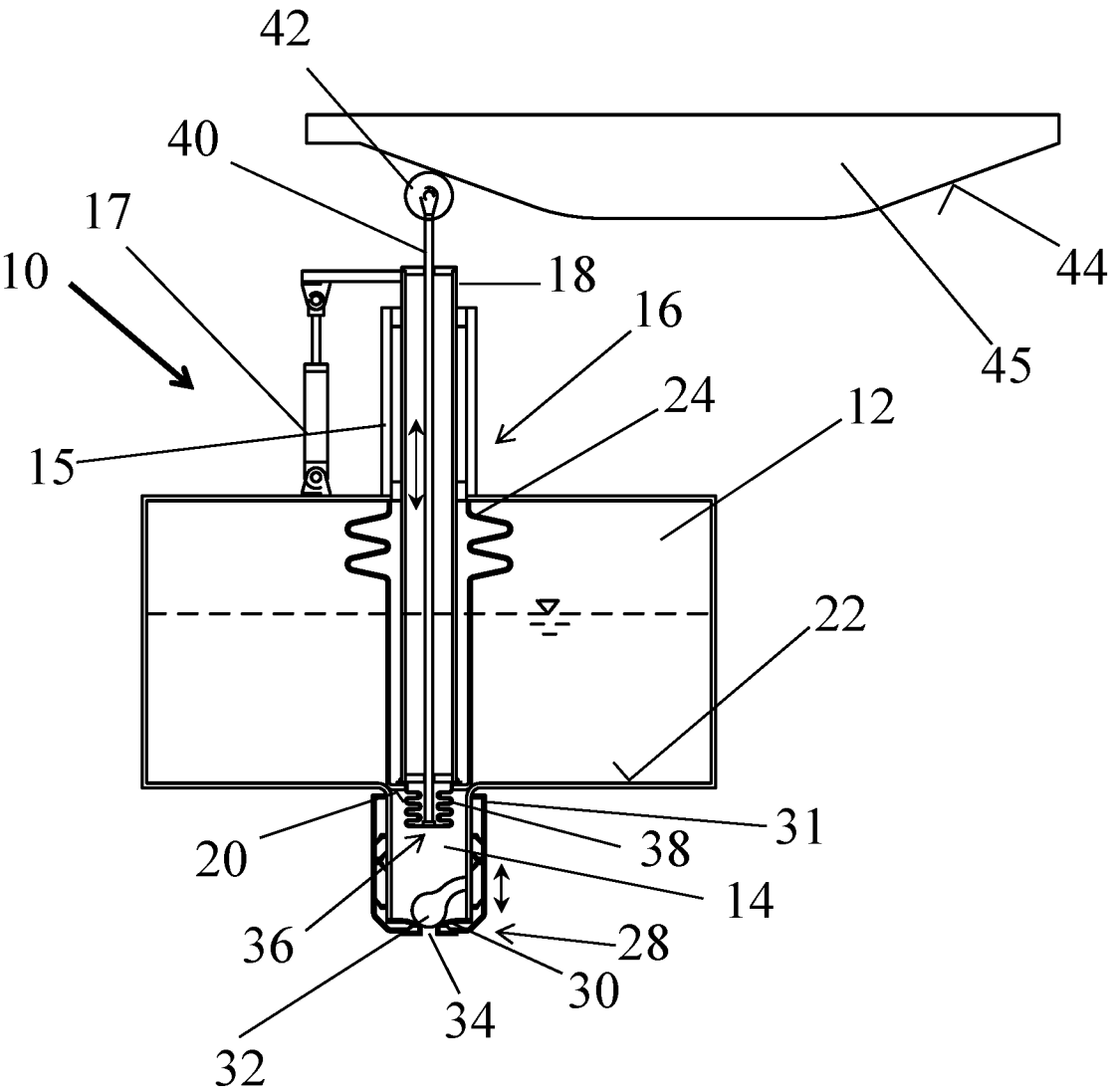

In FIG. 2, the roller 42 has already rolled along part of the guide surface 44, thereby deflecting the pushrod 40 downward. Because the second bellows 38 is usually stiffer than the first bellows 24, as the pushrod 40 moves, the inner piston 36 and the second bellows 38 move the outer piston 18 downwards. This continues until the lower end 20 comes to rest against the product container's base 22. This isolates the pre-filling chamber 14 from the product container 12. The valve 28 that forms the pre-filling chamber 14 remains closed.

In an alternative implementation, the actuator 17 causes the entire movement, and in particular, the downward movement. Meanwhile, suitable stops entrain the inner piston 36. This implementation makes it easier to adapt a control cam to different movement sequences.

Figure 3:
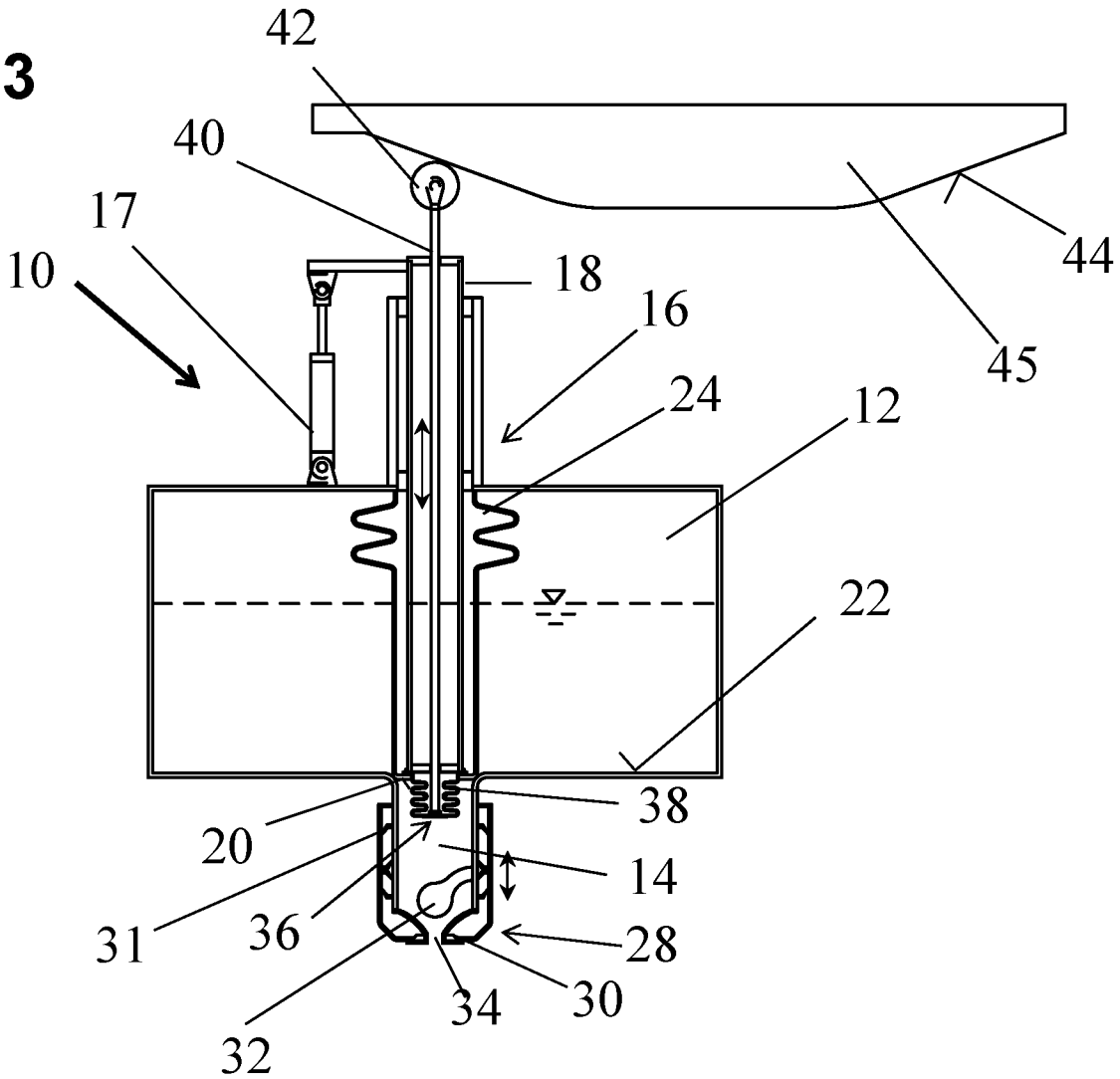

FIG. 3 shows the configuration after a controller causes a drive to move the control cylinder 31 downward. This causes the outlet 34 to open, thus permitting product delivery through the outlet 34.

Figure 4:
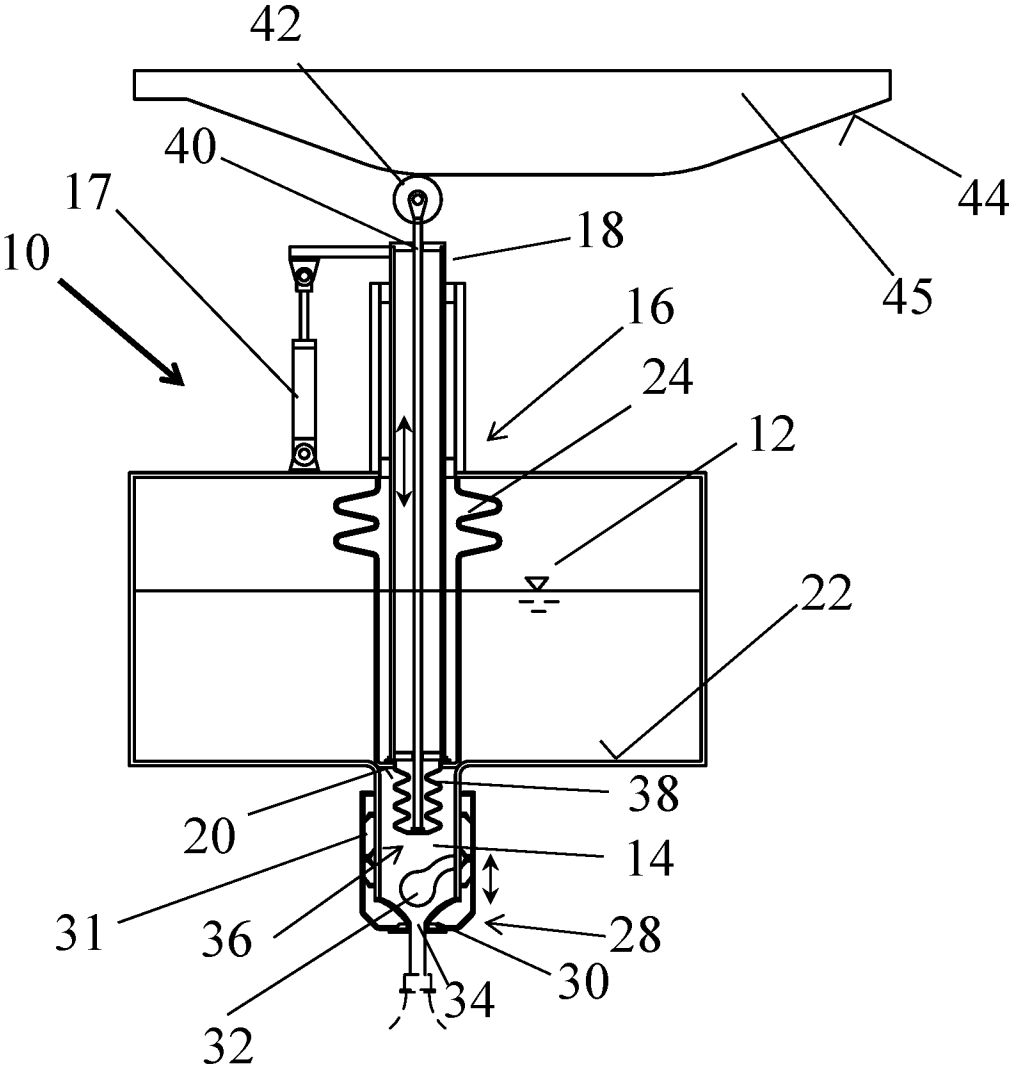

In FIG. 4, the roller 42 has reached the lowest section of the guide surface 44. In this position, the inner piston presses into the pre-filling chamber 14 and the second bellows 38 expands. The resulting displacement ejects a defined amount of product through the open outlet 34.

Figure 5:
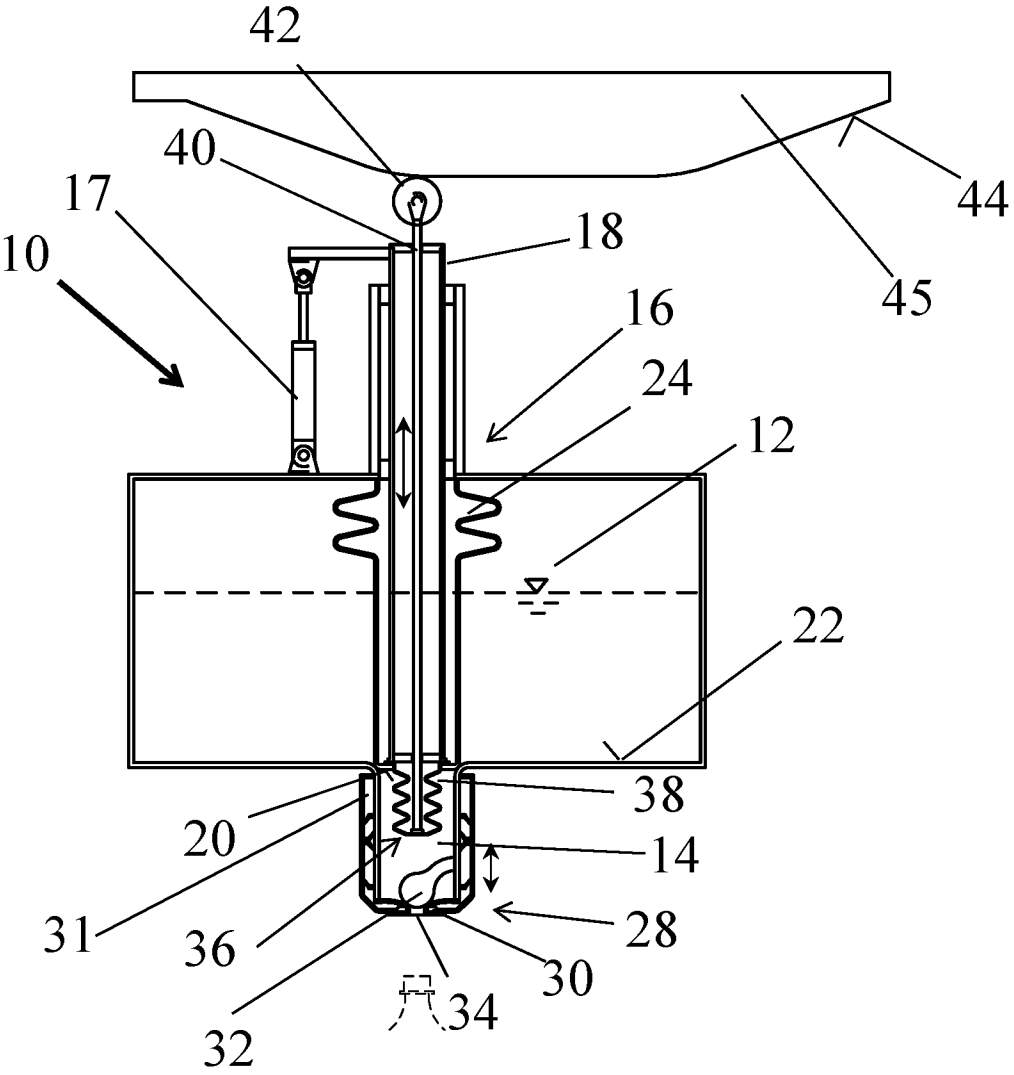

Referring now to FIG. 5, at the end of the product delivery operation shown in FIG. 4, the control cylinder 31 moves back upward and closes the outlet 34. The membrane 30 comes to rest against the seal 32 and the valve 28 closes.

Figure 6:
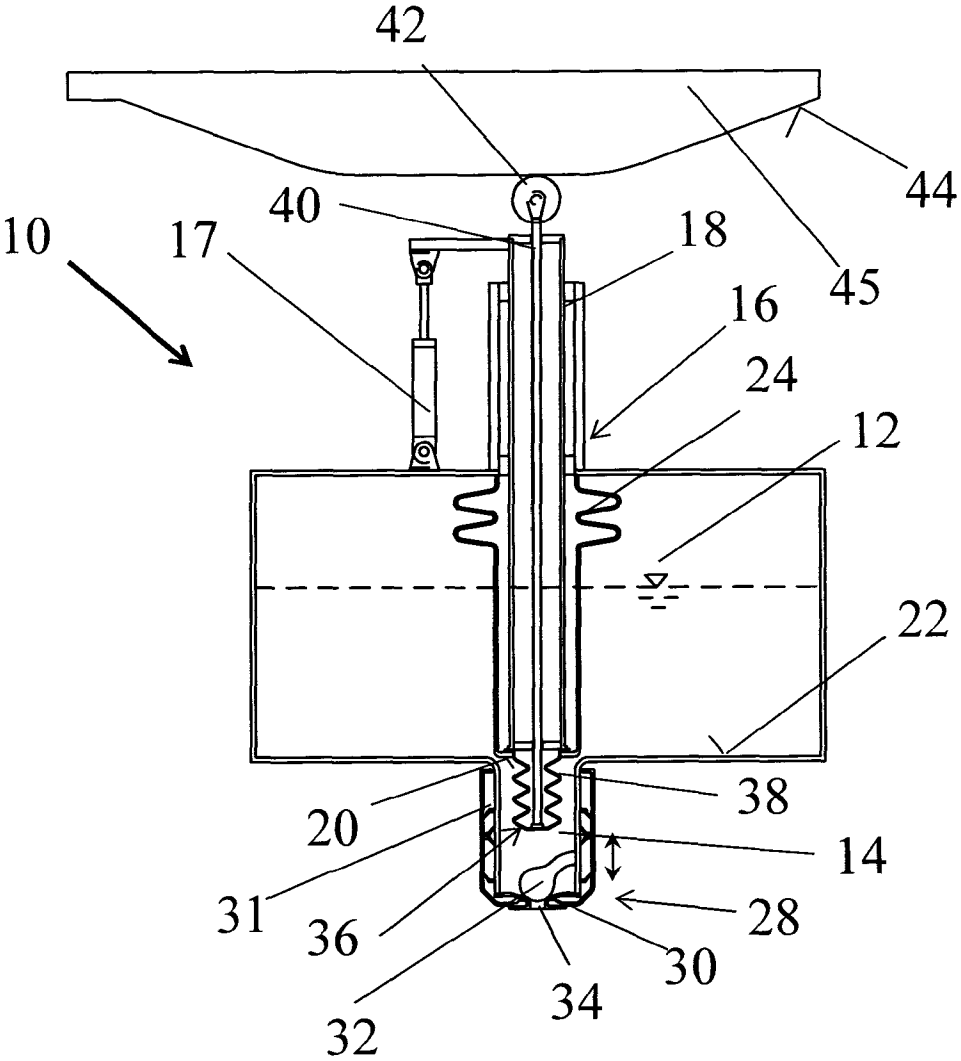
Figure 7:
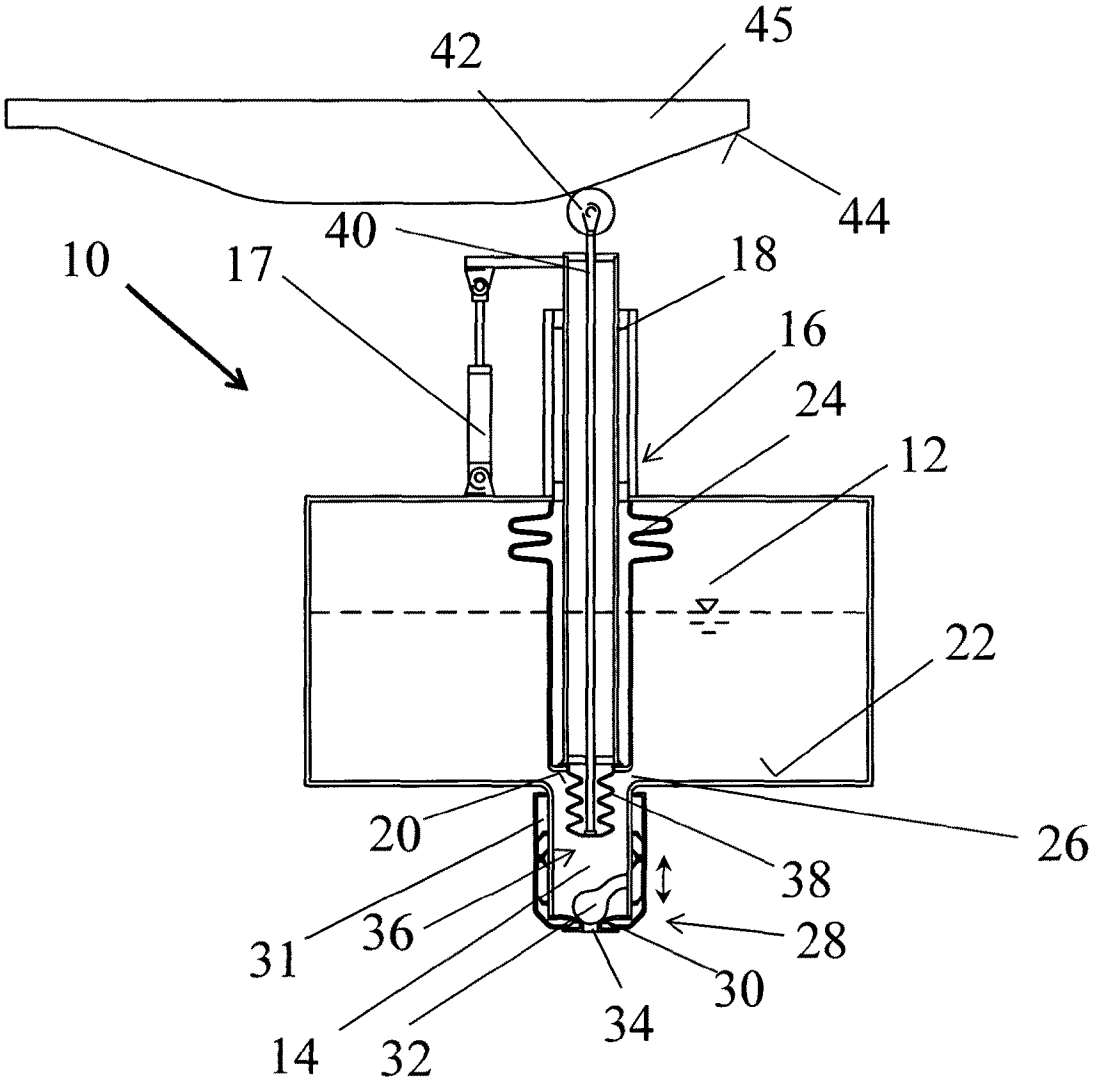
Figure 8:
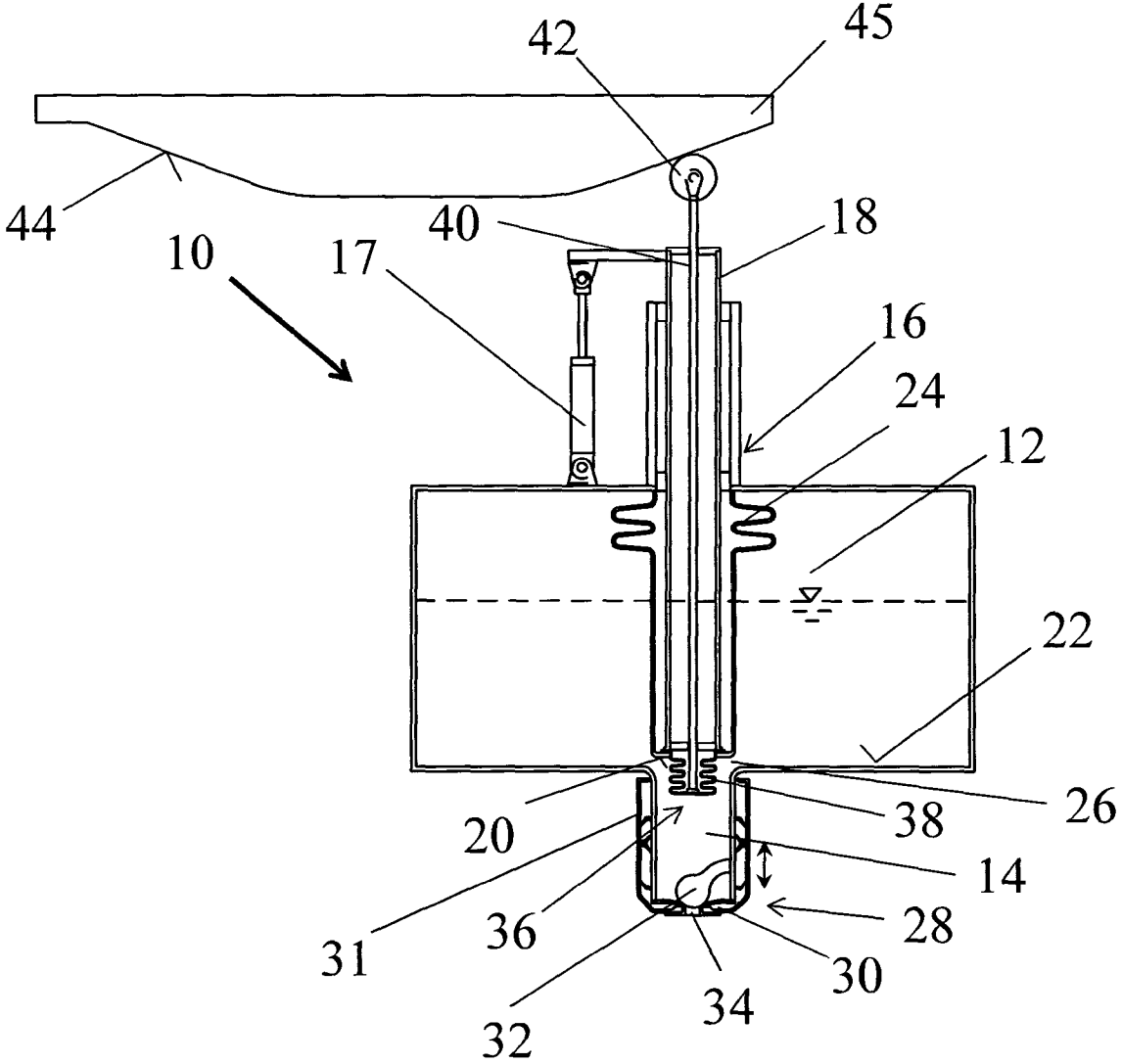

Referring now to FIGS. 6 and 7, the actuator 17 moves the outer piston 18 from its closed position up into its open position so that its lower end 20 lifts off from the product container's base 22. This re-opens the feed 26 from the product container 12 to the pre-filling chamber 14. Since, according to FIG. 7, the roller 42 of the pushrod also slides back upward along the guide surface 44, the inner piston 36 also returns to its retracted position as shown in FIG. 8. This, in turn, is the starting position for a new filling sequence as shown in FIG. 1.

It is especially advantageous if, either before or as the outer piston 18 lifts off, the inner piston 36 moves downward a little further so as to create an equal or positive pressure or prevent a negative pressure that would hinder or even prevent the outer piston 18 from lifting-off. Such a pressure differential at this location would also cause the product to be sucked into the pre-filling chamber 14.

Figure 9:
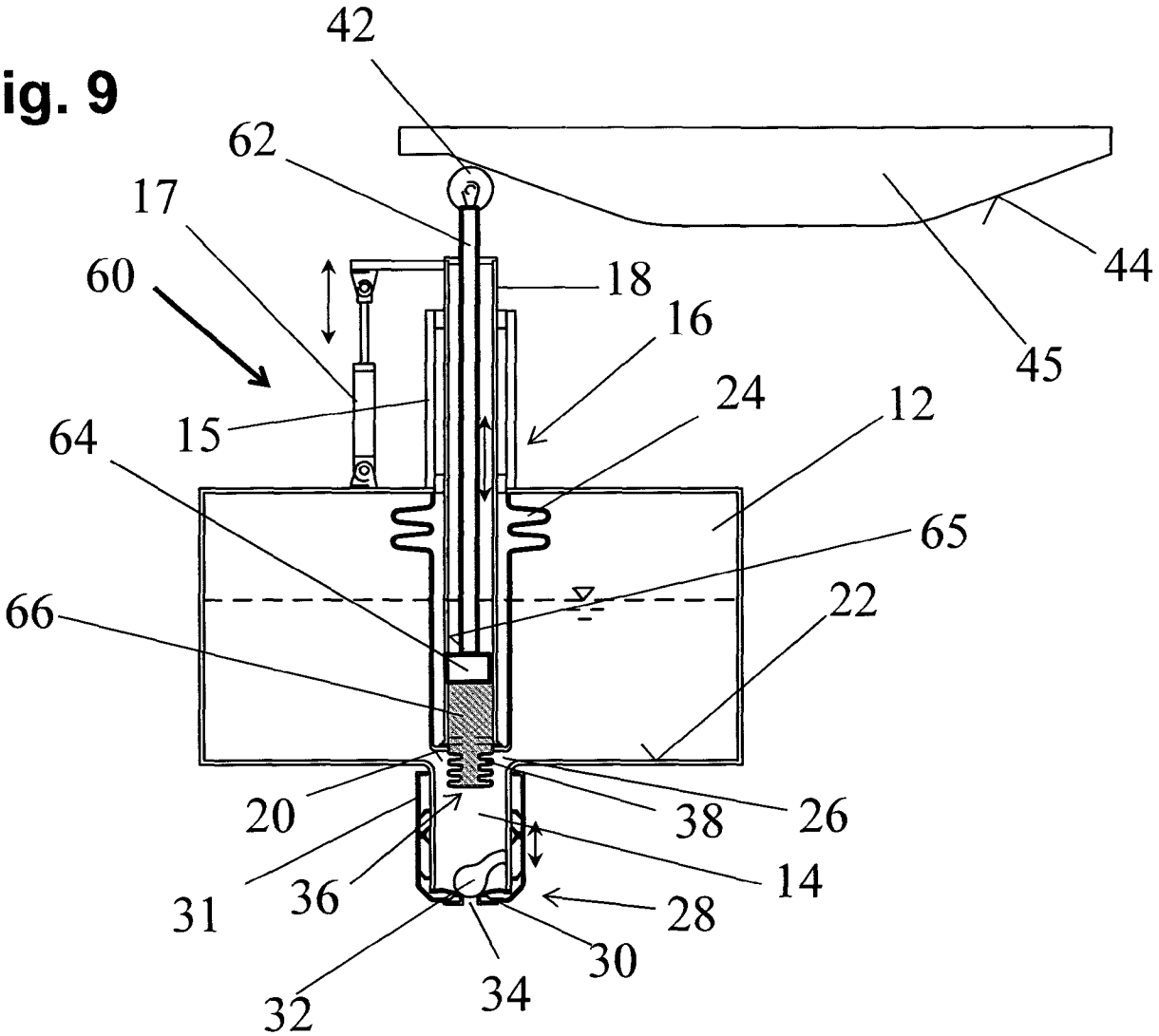
FIG. 9 shows a partial-section side view of an alternative embodiment of a filling apparatus having a fluid-operated displacer arrangement.

FIG. 9 shows an embodiment of a filling apparatus 60 that is broadly analogous with that shown in FIGS. 1 to 8. In this embodiment, the pushrod 62 has, at its bottom end, a piston element 64 that slides axially in a central bore 65 of the outer piston 18.

In the embodiment shown in FIG. 9, an incompressible fluid 66, such as water or oil, fills a space between the piston element 64 and the second bellows 38. This fluid 66 causes the piston element 64 to deflect the bellows 38 into the pre-filling chamber 14. As a result, this deflection is essentially wear-free and subject to only a minimum of friction. The fluid 66 presses against the entire inner surface of the bellows 38, thereby ensuring that it remains unconstricted.

Figure 10:
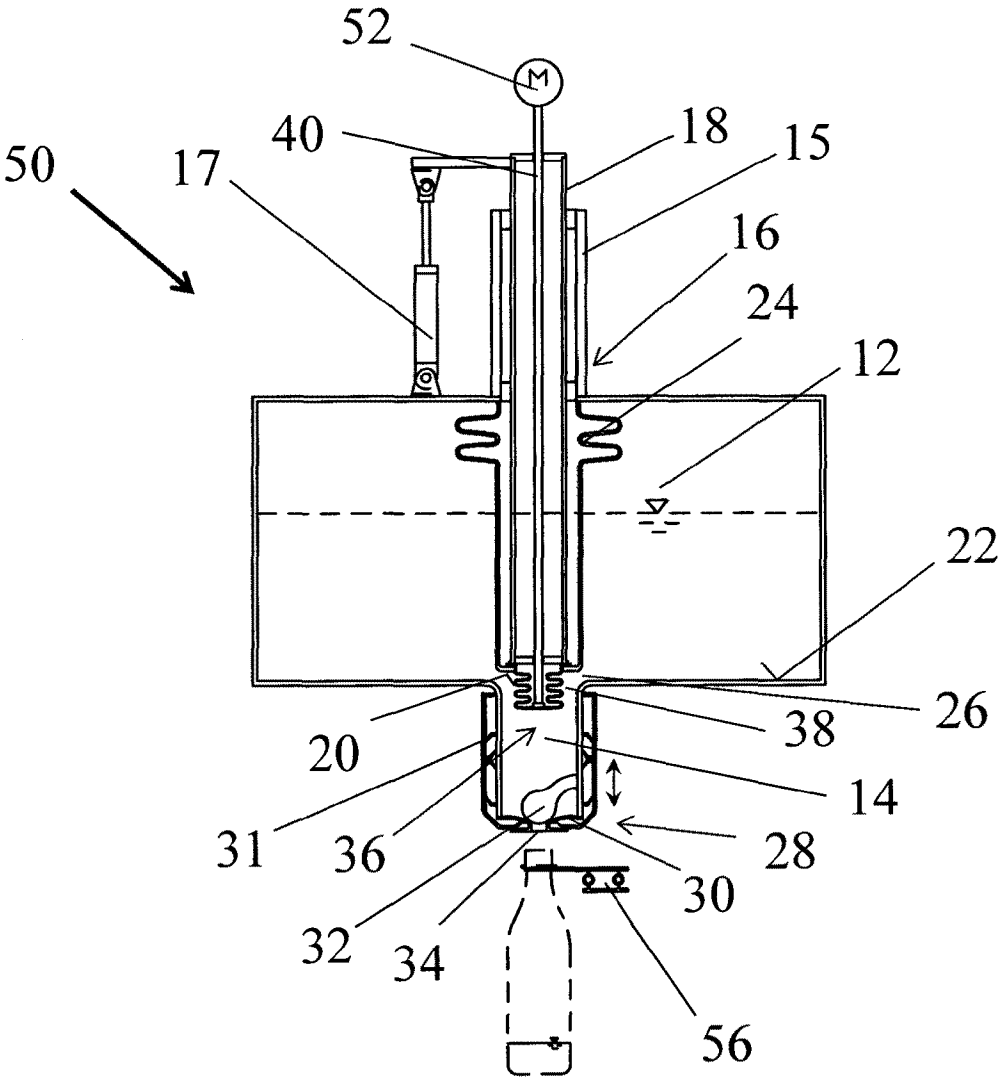
FIG. 10 shows a partial-section side view of another embodiment of a motor-operated filling apparatus that has an additionally arranged load cell for monitoring and regulating the pre-filling.

In the embodiment shown in FIGS. 1-8, a guide surface 44 deflects the push rod 40. However, it is also possible to deflect the push rod 40 using a drive 52, as shown in FIG. 10. Examples of such a drive 52 include a linear motor or control cylinder. In this embodiment, it is possible to precisely set the displaced volume by exercising precise control over the drive 52.

This embodiment also includes an optional load cell 56 to check the correctness of the filled volume and/or to establish a control circuit. In addition, the pushrod 40 is optionally driven by a single drive 52 such as a linear motor or control cylinder.

Figure 11:
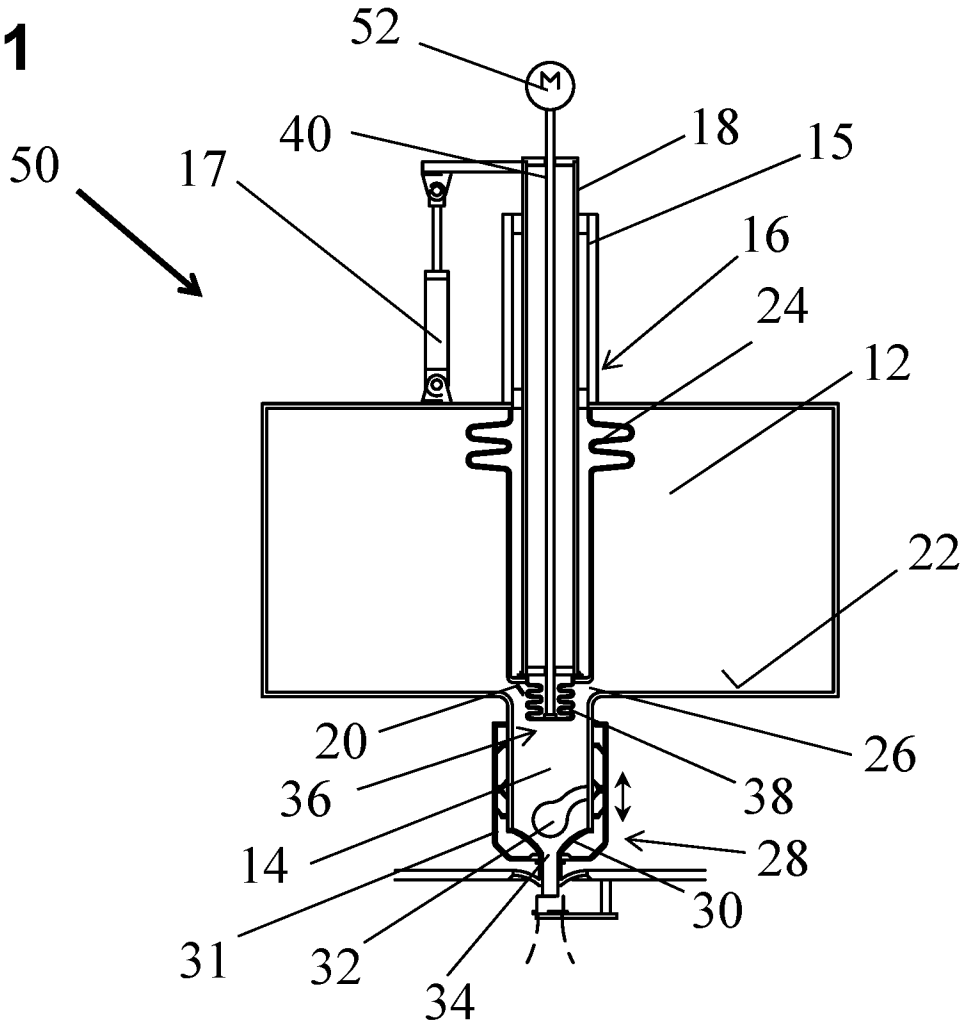
FIG. 11 shows a partial-section side view of another embodiment of a motor-operated filling apparatus that has an aseptic pre-filling chamber.

FIG. 11 shows an aseptic version of the embodiment shown in in FIG. 10. In this aseptic version, the membrane 30 extends into an inlet tube that covers the mouth of a container to be filled. A tight attachment between the membrane 30 and the bottom of the pre-filling chamber 14 assures separation between the sterile space and other filling elements.

A sterile space in which all or some of the containers are arranged and conveyed during filling operations is ideally provided under the filling valve, with essentially only the container carriers being provided within this sterile space as handling elements. The filling elements and all other elements that are part of the filler are located either above or outside the sterile space.

Figure 12:
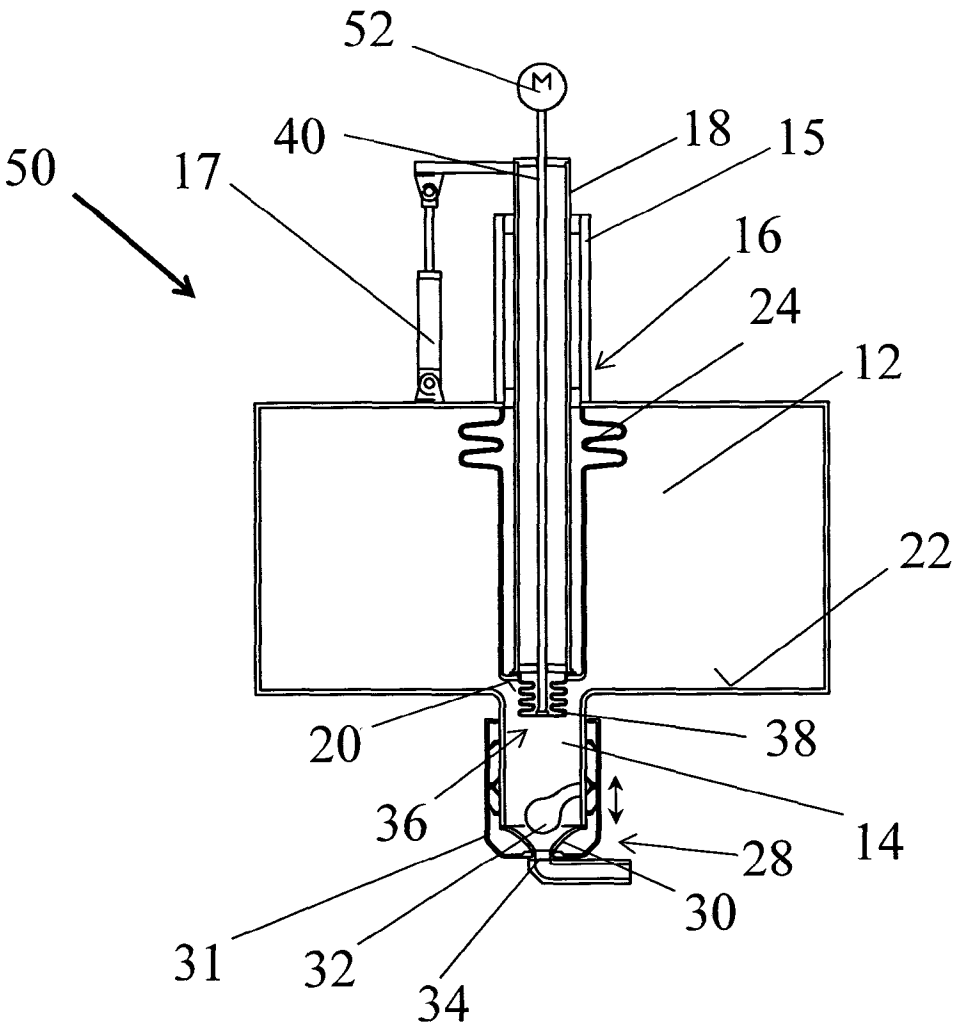
FIG. 12 shows a partial-section side view of an embodiment of a motor-operated filling apparatus according to FIG. 10 during a closed CIP operation.

FIG. 12 shows an embodiment analogous to that of FIG. 10 with a closed CIP operation (cleaning-in-place) in progress. As illustrated, the outer piston 16 is in the open position relative to the product container 12, while the seal 32 is in the open position relative to and spaced apart from the elastic membrane 30. Consequently all parts that come into contact with the product can be cleaned under pressure. Because of the two bellows, no sliding seal faces come into contact with the product. As shown in FIGS. 9 to 11, a single drive 52 operates the pushrod 40. However it is also possible to actuate the pushrod 40 with a roller 42 rolling on a guide surface 44 of a control element 45, as shown in FIGS. 1 to 8.

Among the advantages of the illustrated embodiments is that the displacer arrangement 36, which in this case comprises the second bellows, projects in a free-hanging or protruding manner into the pre-filling volume 14. Accordingly, in the filling step, volume expansion by the displacer arrangement 36 multilaterally displaces the filling volume out of the pre-filling volume. In some embodiments, the displacer arrangement 36 is held or mounted on only one surface of the pre-filling volume 14 or on one side of the pre-filling volume 14.

Figure 13:
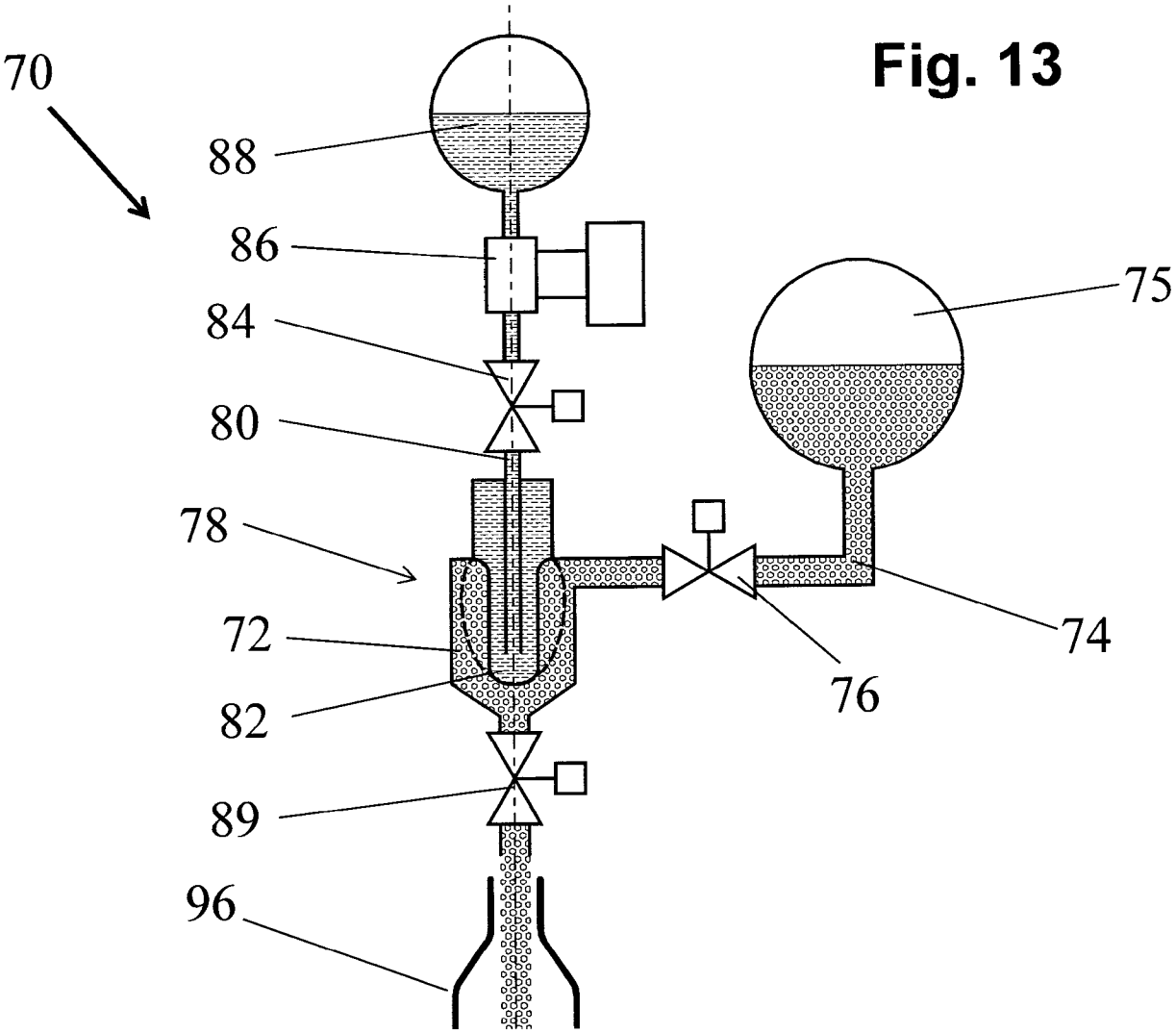
FIG. 13 shows a partial-section side view of another embodiment of the invention that has a balloon as part of the displacer arrangement.

FIG. 13 shows a further embodiment of a filling apparatus 70 having a pre-filling chamber 72, a product supply 74, a product container 75, and a stop valve 76 arranged between the product supply 74 and the pre-filling chamber 72. The product present in the product container 75 can be a liquid that has product pieces and/or a liquid having a viscosity greater than that of water.

A displacer arrangement 78 projects down into the pre-filling chamber 72 from above. The displacer arrangement 78 has an outlet pipe or supply pipe 80 and a rubber layer or elastic polymer layer 82. The polymer layer 82, which is attached to the top of the pre-filling chamber 72 and sealed, defines a balloon that surrounds the supply pipe 80. When the pressure within the fluid container 88 is less than the pressure within the product container 75, the polymer layer 82 lies up against the supply pipe 80.

A proportioning valve 84 and a flow meter 86 are arranged in the supply pipe 80 above the pre-filling chamber 72, with the flow meter 86 being above the proportioning valve 84. Preferably, the flow meter 86 measures flow in either direction. A suitable type of flow meter 86 is a magnetic induction flow meter.

The upper end of the supply pipe 80 ends in a fluid container 88 that draws the pressure fluid that is used to expand the space within the polymer layer 82. A filling valve 89 is arranged at the lower end of the pre-filling chamber 72. Control over the filling apparatus 70 includes alternately using the stop valve 76, the proportioning valve 84 and the filling valve 89 to apply three different pressure levels: a pressure-fluid pressure, a product pressure, and atmospheric pressure, with the pressure-fluid level being between the product pressure and atmospheric pressure.

Embodiments that use a coupling fluid to hydraulically cause displacement include a fluid container 88 with suitable actuators and control elements. In some of these embodiments, all filling elements or their respective displacer elements connect to just one central fluid container 88. In some embodiments, the central fluid container 88 is an annular channel or tank. Only one central unit, such as a pump or infeed, is needed to set the desired pressure level in the respective fluid container.

During the filling operation, the stop valve 76 closes and the proportioning valve 84 and the filling valve 89 open. This pushes a defined quantity of pressure fluid into the interior defined by the polymer layer 82. The flow meter 86 measures the relevant amount. The pressure fluid itself can be oil or water.

In response, the polymer layer 82 expands and forms a balloon, as indicated by the broken line. As it does so, a defined volume of the product is delivered from the pre-filling chamber 72 through the filling valve 89 and into a container 96, such as a bottle.

After the filling operation, the filling valve 89 closes and the stop valve 76 opens. This exposes the pressure fluid to pressure in the product container 75, which is higher than that in the fluid container 88. As a result, pressure fluid that had been pushed into the interior inside the polymer layer 82 is now pushed back into the fluid container 88. This causes the polymer layer 82 to lies against the supply pipe 80 once again. In some embodiments, a pump can be used to achieve the same function.

By using a pump or suitable pressure ratios in the corresponding containers, the defined amount of product is delivered from the product container 75 into the pre-filling chamber 72, thus readying the filling apparatus 70 for the next filling operation.

Figure 14:
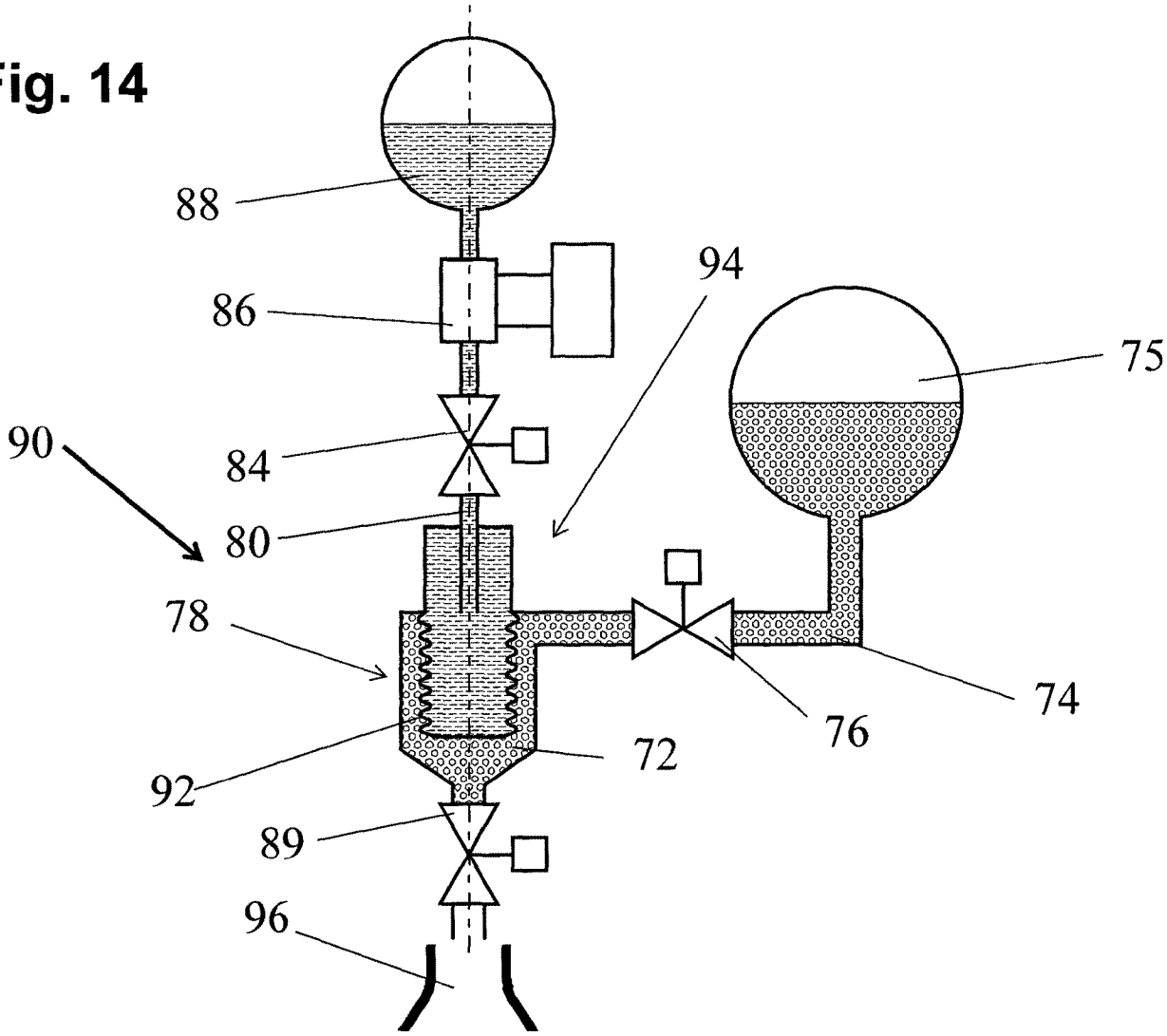
FIG. 14 shows a partial-section side view of another embodiment of the invention that has a bellows as part of the displacer arrangement.

FIG. 14 shows an embodiment of a filling apparatus 90 that is broadly identical to that shown in FIG. 13, in which identical parts that have the same functions are indicated by the same reference numbers. Unlike the embodiment 70 in FIG. 13, the filling apparatus 90 does not use a balloon-like polymer layer 82. Instead, it relies on a bellows 92 that forms part of the displacer arrangement 94. This bellows 92 has the same function as the polymer layer 82 in the embodiment 70 shown in FIG. 13.

In some embodiments, the bellows 92 consists of a relatively rigid material because in this case the change in volume can be realized by the relative movement of the parts of the bellows relative to one another. As in FIG. 13, a pressure fluid is applied to the bellows 92. The operation is controlled as was explained in conjunction with FIG. 13.

The invention claimed is:

1. An apparatus for filling containers with a material, said apparatus comprising a product supply, a pre-filling chamber, a movable sealing-arrangement, a displacer arrangement, an elastically-deformable wall, a controllable outlet, a control surface, and a dual-piston arrangement comprising an inner piston and an outer piston, wherein said pre-filling chamber is isolatable from said product supply, wherein said pre-filling chamber comprises said controllable outlet, wherein said movable sealing-arrangement has a closed position for isolating said product supply from said pre-filling chamber, wherein said displacer arrangement is extendible into said pre-filling chamber, wherein said displacer arrangement comprises said elastically-deformable wall, wherein said displacer arrangement is interactively connected to said control surface in such a way that deformation of said elastically-deformable wall causes a volume change in said displacer arrangement that changes a volume of said pre-filling chamber, thereby permitting control over an amount of product delivered through said outlet, wherein said inner and outer pistons are concentric, and wherein said inner and outer pistons are arranged to interact telescopically.

2. The apparatus of claim 1, further comprising a bellows, wherein said bellows forms said elastically-deformable wall and wherein said bellows protrudes into said pre-filling chamber.

3. The apparatus of claim 1, wherein said movable sealing-arrangement comprises said dual-piston arrangement.

4. The apparatus of claim 1, wherein said outer piston isolates said pre-filling chamber from said product supply when said movable sealing-arrangement is in said closed position, and wherein said inner piston forms said displacer arrangement.

5. The apparatus of claim 4, wherein, when said movable sealing-arrangement is in said closed position, said inner piston is movable into said pre-filling chamber so as to displace a predefined amount of product.

6. The apparatus of claim 4, further comprising a bellows, wherein said bellows seals said inner piston from said outer piston.

7. The apparatus of claim 4, wherein said inner piston is configured as a bellows.

8. The apparatus of claim 4, further comprising a bellows, wherein said bellows isolates said outer piston from said product supply.

9. The apparatus of claim 5, further comprising an actuator that is configured to move said inner piston.

10. The apparatus of claim 9, wherein a resistance that hinders relative movement between said inner piston and said outer piston exceeds a resistance that hinders relative movement between said outer piston and said product supply.

11. The apparatus of claim 9, further comprising a piston element, wherein said actuator connects to said piston element, wherein said outer piston comprises an axial bore in which said piston element is moveable, wherein said inner piston is arranged at one end of said outer piston, wherein said inner piston is connected to said bore, and wherein the arrangement of the piston element and the inner piston results in an ability to have fluid be arranged between said piston element and said inner piston.

12. The apparatus of claim 1, further comprising an actuator, wherein said actuator lowers said outer piston to isolate said product container from said pre-filling chamber.

13. The apparatus of claim 1, wherein said product supply comprises a product container, wherein said outer piston extends vertically through said product container, and wherein a lower end of said outer piston seats against an opening into said pre-filling chamber.

14. The apparatus of claim 1, further comprising a valve, an outlet opening, and an actuator, wherein said valve comprises a closing element and an elastic membrane, wherein said elastic membrane is arranged around said outlet opening, and wherein said actuator is configured to move said elastic membrane relative to said closing element.

15. The apparatus of claim 1, wherein said displacement arrangement comprises a mechanical piston and a bellows, and wherein said piston actuates said bellows.

16. The apparatus of claim 1, wherein said displacement arrangement comprises a fluid-actuated bellows.

17. The apparatus of claim 1, wherein said displacement arrangement is configured such that increasing a volume of said displacement arrangement causes discharge of a corresponding volume of said material from said pre-filling chamber.

18. The apparatus of claim 1, wherein said deformation of said elastically-deformable wall causes ejection of product through said outlet and wherein displacement of said elastically-deformable wall also causes product to be sucked into said chamber from said product supply.

19. The apparatus of claim 1, wherein said elastically-deformable wall protrudes into said pre-filling chamber.

20. An apparatus for filling containers with a material, said apparatus comprising a product supply, a pre-filling chamber comprising a controllable outlet, a movable sealing-arrangement that transitions into a closed position in which said product supply is isolated from said pre-filling chamber, said movable sealing-arrangement comprising concentric inner and outer pistons that are arranged for telescopic interaction with each other, a displacer arrangement that extends into said pre-filling chamber and that comprises an elastically-deformable wall, and a control surface that is interactively connected to said displacer arrangement so as to cause deformation of said wall, said deformation resulting in an increase and then a decrease in volume of said displacer arrangement while said displacer arrangement is within said pre-filling chamber, wherein an extent of said increase in said volume of said displacer arrangement results in a corresponding decrease in volume of said pre-filling chamber, which then results in ejection of a corresponding volume of said material through said controllable outlet.

21. The apparatus of claim 1, wherein said inner and outer pistons are configured such that as said outer piston lifts off to connect said pre-filling chamber to said product supply, said inner piston extends further into said pre-filling chamber thereby avoiding a pressure differential that would otherwise hinder said outer piston from lifting off.

* * * * *